US009963889B2

(12) United States Patent
Shen et al.

(10) Patent No.: US 9,963,889 B2
(45) Date of Patent: May 8, 2018

(54) SEALED AND INTEGRATED CLIMBING SCAFFOLD AND METHOD FOR USING THE SAME

(71) Applicant: SHENZHEN TECHEN TECHNOLOGY CO., LTD, Shenzhen, Guangdong (CN)

(72) Inventors: Haiyan Shen, Guangdong (CN); Jianen Han, Guangdong (CN)

(73) Assignee: SHENZHEN TECHEN TECHNOLOGY CO., LTD, Shenzhen (CN)

( * ) Notice: Subject to any disclaimer, the term of this patent is extended or adjusted under 35 U.S.C. 154(b) by 324 days.

(21) Appl. No.: 14/109,860

(22) Filed: Dec. 17, 2013

(65) Prior Publication Data

US 2015/0167326 A1 Jun. 18, 2015

(51) Int. Cl.

| | |
|---|---|
| ***E04G 3/28*** | (2006.01) |
| ***E04G 3/32*** | (2006.01) |
| ***E04G 5/04*** | (2006.01) |
| *E04G 11/28* | (2006.01) |

(52) U.S. Cl.

CPC ..... *E04G 3/32* (2013.01); *E04G 5/04* (2013.01); *E04G 5/046* (2013.01); *E04G 11/28* (2013.01); *E04G 2003/286* (2013.01)

(58) Field of Classification Search

CPC .. E04G 3/28; E04G 11/28; E04G 3/32; E04G 3/30; E04G 3/12; E04G 5/046; E04G 2003/286; E04G 5/04

USPC ..... 249/18–22

See application file for complete search history.

(56) References Cited

U.S. PATENT DOCUMENTS

| | | | | |
|---|---|---|---|---|
| 4,892,169 | A * | 1/1990 | Duncan | E04G 21/3223 182/138 |
| 9,212,026 | B2 * | 12/2015 | Holawe | B66B 9/16 |
| 9,803,384 | B2 * | 10/2017 | Blinn | E04G 21/3204 |
| 2003/0052249 | A1 * | 3/2003 | Waldschmitt | E04G 11/28 249/20 |

(Continued)

FOREIGN PATENT DOCUMENTS

| | | | | |
|---|---|---|---|---|
| CN | 102107825 | A | 6/2011 | |
| CN | 102635227 | A * | 8/2012 | E04G 3/28 |

(Continued)

*Primary Examiner* — Daniel P Cahn

(57) ABSTRACT

The present application relates to a sealed and integrated climbing scaffold, comprising a hollow frame structure, a plurality of mechanical arm devices, a plurality of climbing fulcrums, a lifting system, and a construction operation platform structure; wherein, the hollow frame structure includes an inner guide rail and an outer guide rail, the inner guide rail and the outer guide rail are capable of sliding relative to each other; at least two of the mechanical arm devices are fixed on the outer guide rail, at least two of the mechanical arm devices are fixed on the inner guide rail. When implementing the sealed and integrated climbing scaffold of the present application, it improve the level of mechanization and automation in lifting platform of high-rise construction, improve the efficiency of construction, save the workforce, realize standardization and modularization, effectively protect the internal lifting system and decline equipment failure rate.

11 Claims, 12 Drawing Sheets

(56) References Cited

U.S. PATENT DOCUMENTS

| | | | | |
|---|---|---|---|---|
| 2005/0217934 | A1* | 10/2005 | Choo | E04G 3/28 182/82 |
| 2007/0119116 | A1* | 5/2007 | Arozena Bergaretxe | E04G 11/28 52/633 |
| 2008/0257644 | A1* | 10/2008 | Schwoerer | E04G 11/24 182/142 |
| 2009/0014241 | A1* | 1/2009 | Ashmus | A62B 1/10 182/196 |
| 2009/0146041 | A1* | 6/2009 | Schwoerer | E04G 11/20 249/20 |
| 2010/0038518 | A1* | 2/2010 | Schwoerer | E04G 11/28 249/20 |
| 2010/0212237 | A1* | 8/2010 | Schwoerer | E04G 11/28 52/122.1 |
| 2011/0171336 | A1* | 7/2011 | Schwoerer | E04G 11/28 425/63 |
| 2011/0214824 | A1* | 9/2011 | Beristain | E04G 21/16 160/368.1 |
| 2012/0168251 | A1* | 7/2012 | Baxter | B66C 23/205 182/129 |
| 2016/0040441 | A1* | 2/2016 | Dingler | E04G 3/28 248/241 |
| 2017/0226756 | A1* | 8/2017 | Hyvonen | E04G 3/28 |

FOREIGN PATENT DOCUMENTS

| | | | | |
|---|---|---|---|---|
| CN | 102677884 | A * | 9/2012 | E04G 3/28 |
| CN | 103669818 | * | 9/2012 | E04G 3/28 |
| CN | 103669818 | A | 3/2014 | |
| WO | 2003074818 | A1 | 9/2003 | |

* cited by examiner

A-A

1

SEALED AND INTEGRATED CLIMBING SCAFFOLD AND METHOD FOR USING THE SAME

TECHNICAL FIELD

The present application relates to the field of elevating mechanisms, and more particularly, relates to a sealed and integrated climbing scaffold for high-rise construction lifting platforms and a method for using the same.

BACKGROUND

Nowadays, although many high-rise construction lifting platforms have already partly realized mechanization and automation of lifting systems, the lifting systems still need many persons to do auxiliary work. For example, workers may need to carry heavy components, such as guide bases, electric hoists and lifting point bearings, up and down stairs by hand. When a scaffold is elevated to a predetermined fastening place, the workers may also need to lock locating fasteners by hand. Thus, the workers' labor intensity and construction cost are increased, and construction efficiency is reduced. Moreover, many equipments of typical high-rise construction lifting platforms, such as lifting systems, attachment lifting points, guide rails, wall attachment brackets, anti-dropping devices, and so on, need to be assembled in the construction site. The assembly operations not only occupy the space of the construction site but also require a great deal of manual operation. Thus, the construction process is messy and may have a high failure rate. Furthermore, because most typical high-rise construction lifting platforms lack sufficient dustproof measures, dust and other impurities are prone to enter the lifting systems. In bad construction environments, the equipments of the typical high-rise construction lifting platforms are prone to be polluted, the inner lifting systems of the typical high-rise construction lifting platforms may be damaged, and equipment failures may occur frequently.

BRIEF SUMMARY

The objective of the present application is to provide a sealed and integrated climbing scaffold and a method for using the same, which can reduce the work of carrying guide bases of high-rise construction lifting platforms, and the work of connecting and disconnecting attachment lifting points of high-rise construction lifting platforms, and can also improve the levels of mechanization and automation in construction.

The technical solutions of the present application for solving the technical problems are as follows:

The present application provides a sealed and integrated climbing scaffold, comprising a hollow frame structure, a plurality of mechanical arm devices, a plurality of climbing fulcrums, a lifting system, and a construction operation platform structure; wherein, the hollow frame structure includes an inner guide rail and an outer guide rail, the inner guide rail and the outer guide rail are assembled together and are capable of sliding relative to each other; at least two of the mechanical arm devices are fixed on the outer guide rail, and at least two of the mechanical arm devices are fixed on the inner guide rail; the climbing fulcrums are configured to be fixed on every floor of a building; each of the mechanical arm devices includes a catch-and-release structure configured for catching the climbing fulcrums; the inner guide rail and the outer guide rail are connected with the lifting system respectively, the lifting system is received in the hollow frame structure, and the construction operation platform structure is fixedly connected with the outer guide rail; the outer guide rail includes a guide rail upright pole, two connecting plates fixed on two opposite sides of the guide rail upright pole respectively, and two slide ways fixedly connected with the two connecting plates respectively.

In one embodiment, each of the two connecting plates includes a plurality of sub-plates combined together. The inner guide rail, the guide rail upright pole, the connecting plates, and the slide ways are all made of aluminum alloy section bar.

In this embodiment, the sealed and integrated climbing scaffold further comprises a dust-proof cover mounted at the top of the hollow frame structure. The hollow frame structure further includes a mounting bracket, and the mounting bracket is connected with the guide rail upright pole and the bottom of each of the slide ways.

In this embodiment, the sealed and integrated climbing scaffold further comprises a dust shield mounted outside the lifting system and a plurality of dust-seal plates. A moving gap is formed between each end of the inner guide rail and an inner wall of the outer guide rail, the dust-seal plates cover the moving gaps.

In this embodiment, each of the climbing fulcrums includes a pedestal and a pin shaft fixed on the pedestal. Each of the mechanical arm devices includes a mechanical arm, an axle, and a supporting base, and the mechanical arm is rotatably connected with the supporting base via the axle. Each of the mechanical arm devices further includes a locking device configured for locking the mechanical arm on any one of the climbing fulcrums; the locking device includes a stop block, a solenoid valve, a lock plate, a dragging cable, a locating sleeve, a first spring and a mounting plate; the stop block is configured for locking the mechanical arm on any one of the climbing fulcrums, one end of the dragging cable is connected with the solenoid valve, and the other end of the dragging cable extends into the stop block and is mounted on the stop block by the lock plate; the locating sleeve is sheathed on the dragging cable, and the locating sleeve is further fixed on the mounting plate; one end of the first spring abuts against the mounting plate, and the other end of the first spring abuts against either the lock plate or the stop block.

In this embodiment, the catch-and-release structure of each of the mechanical arm devices includes the locking device and an open slot defined in distal end of the mechanical arm of the mechanical arm device and corresponding to the pin shaft of any one of the climbing fulcrums; when the stop block extends outside, the mechanical arm of the mechanical arm device is locked on one of the climbing fulcrums; and when the stop block retracts, the mechanical arm is released from the climbing fulcrum.

In this embodiment, the sealed and integrated climbing scaffold further comprises a retainer and a plurality of embedded screws; the retainer includes a fixing base, a locating and supporting arm and a rotating shaft; the fixing base is mounted on either the outer guide rail or the inner guide rail, the locating and supporting arm is rotatably connected with the fixing base by the rotating shaft, the locating and supporting arm is capable of rotating around the rotating shaft; the locating and supporting arm includes a stop pin, and a first bayonet and a second bayonet are defined in the fixing base; while the locating and supporting arm is rotated to be perpendicular to the outside surface of a building, the stop pin cooperates with the first bayonet for limitation; while the locating and supporting arm is rotated to be parallel to the outside surface of the building, the stop pin cooperates with the second bayonet for limitation; each of the embedded screws is fixedly connected with each of the climbing fulcrums, and any one of the embedded screws is capable of detachably connecting with the locating and supporting arm.

In another embodiment, each of the mechanical arm devices further includes a second spring and a trigger-rod configured to hold the mechanical arm of the mechanical arm device, the trigger-rod is rotatably connected with the supporting base, and two ends of the second spring are respectively fixed on the supporting base of the mechanical arm device and the trigger-rod. The trigger-rod defines a limiting bayonet, and the mechanical arm of the mechanical arm device includes a limiting pin corresponding to the limiting bayonet.

In another embodiment, each of the mechanical arm devices further includes a third spring, and two ends of the third spring are respectively fixed on the supporting base of the mechanical arm device and the mechanical arm of the mechanical arm device.

The present application provides a method for using a sealed and integrated climbing scaffold, comprising the following steps:

S1: rotating a locating and supporting arm mounted on a retainer of the sealed and integrated climbing scaffold to be perpendicular to the outside surface of a building; the sealed and integrated climbing scaffold comprising a plurality of climbing fulcrums, fixing an embedded screw mounted on each of the climbing fulcrums on the locating and supporting arm for location during the early stage of embedding; after firmly embedding the embedded screw in concrete, rotating the locating and supporting arm to be parallel to the outside surface of the building, and fixedly connecting the climbing fulcrums with the embedded screws respectively;

S2: positioning two mechanical arm devices of the sealed and integrated climbing scaffold at the same height and catching the climbing fulcrums fixed on the building at the same time; locking a solenoid valve on an inner guide rail of the sealed and integrated climbing scaffold, powering on the solenoid valve and then the solenoid valve being closed by the suction; and meanwhile, under the action of the solenoid valve's suction, releasing a locking device mounted under the mechanical arm device of the inner guide rail by the pulling force of a dragging cable of the locking device; while elevating the inner guide rail to the climbing fulcrum located at the higher floor of the building by a lifting system of the sealed and integrated climbing scaffold, the mechanical arm device mounted on the inner guide rail automatically catching the climbing fulcrum fixed on the higher floor and firmly locking on the climbing fulcrum; then taking the inner guide rail as the supporting, the locating and the guiding to elevate an outer guide rail of the sealed and integrated climbing scaffold and a construction operation platform structure of the sealed and integrated climbing scaffold by the lifting system;

S3: when descending a construction platform of the sealed and integrated climbing scaffold, the inner guide rail and the mechanical arm device mounted on the inner guide rail holding still; powering on the solenoid valve locked on the outer guide rail and then the solenoid valve being closed by the suction; meanwhile, under the action of the solenoid valve's suction, releasing the locking device mounted under the mechanical arm device of the outer guide rail by the pulling force of the dragging cable; elevating the outer guide rail for a distance by the lifting system, then rotating a mechanical arm of the mechanical arm device down an angle under the control of the solenoid valve, and a trigger-rod of the mechanical arm device limiting the mechanical arm at the same time, then descending the outer guide rail by the lifting system; the trigger-rod touching the outside surface of the building during the descending process of the outer guide rail, and the trigger-rod separating from the mechanical arm; under the action of a second spring of the mechanical arm device and a third spring of the mechanical arm device, the trigger-rod and the mechanical arm rotating to return and backing to the normal state respectively.

When implementing the sealed and integrated climbing scaffold of the present application, the following advantageous effects can be achieved: the mechanical arm devices of the sealed and integrated climbing scaffold can capture the climbing fulcrums by the catch-and-release structures. In the lifting process, either the outer guide rail or the inner guide rail can be elevated at first. For example, if the inner guide rail needs to be elevated at first, the lifting system elevates the inner guide rail at first. During the lifting process, the outer guide rail is held still and provides supporting and locating functions which are similar to the functions of a guide base in the prior art. When the mechanical arm devices on the inner guide rail move up to reach upper climbing fulcrums and catch the climbing fulcrums, elevating the inner guide rail is stopped and elevating the outer guide rail is started. At present, the inner guide rail is held still and provides supporting and locating functions until the mechanical arm devices on the outer guide rail move up to reach higher climbing fulcrums and to catch the higher climbing fulcrums. The descending process of the sealed and integrated climbing scaffold is similar to the lifting process, wherein the mechanical arm devices on the inner guide rail and the mechanical arm devices on the outer guide rail move alternately, too. In the present application, the outer guide rail and the inner guide rail of the sealed and integrated climbing scaffold act as a guide base and a guide rail alternately. Therefore, the sealed and integrated climbing scaffold of the present application can imitate the principal of human climbing movements by using the mechanical arm devices fixed on the inner guide rail and the outer guide rail to move up and down, and thereby realize lifting and descending of high-rise construction platforms. The present application reduces the work of carrying guide bases of high-rise construction lifting platforms, and the work of connecting and disconnecting attachment lifting points of high-rise construction lifting platforms, improves the levels of mechanization and automation in construction and reduces workers' labor intensity. In one building, only one person can easily realize the work of elevating and descending the high-rise construction lifting platform, which can greatly improve the construction efficiency and save much workforce. The components of the hollow frame structure of the present application are simple in assembly, and the hollow frame structure realizes standardization and modularization. Therefore, these components can be assembled together in a factory, and the hollow frame structure has good sealing performance. In this way, the lifting system in the hollow frame structure can be effectively protected, and the equipment failure rate can be reduced.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

Figure 1:
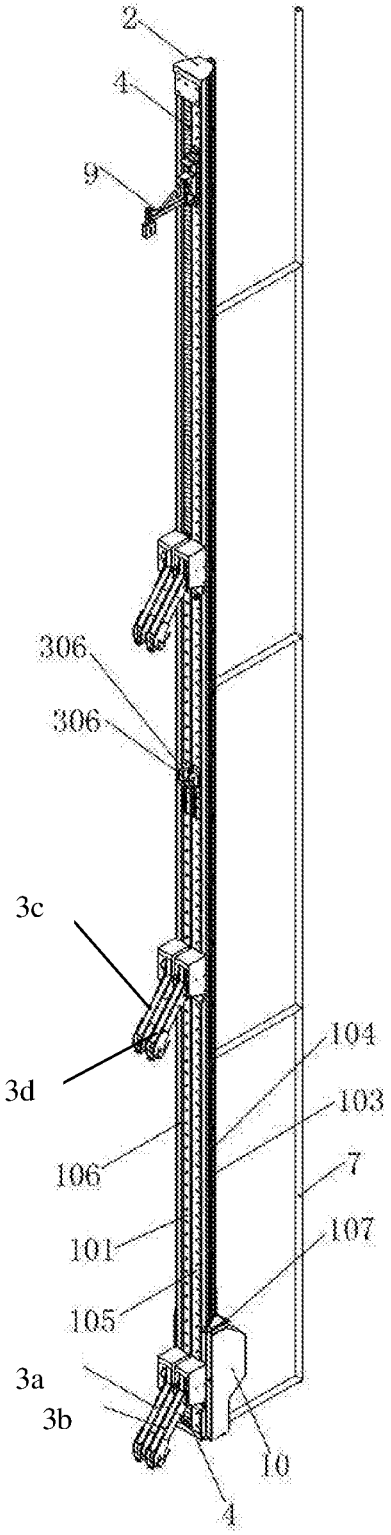
FIG. 1 is a structural schematic view of a sealed and integrated climbing scaffold, according to a first embodiment of the present application.
Figure 2:
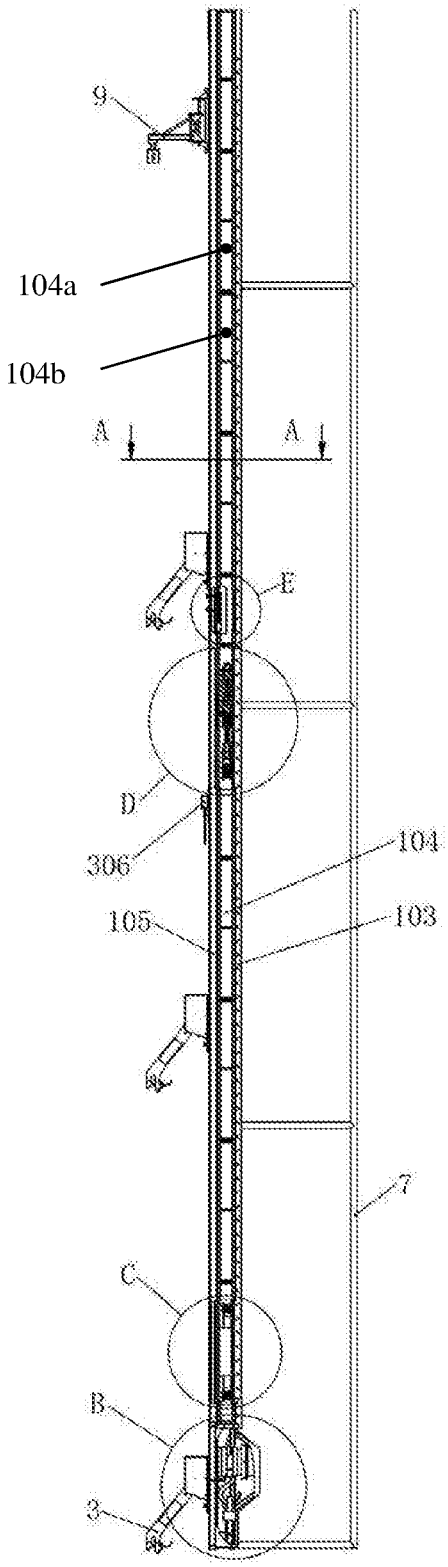
FIG. 2 is a side view of the sealed and integrated climbing scaffold shown in FIG. 1.
Figure 3:
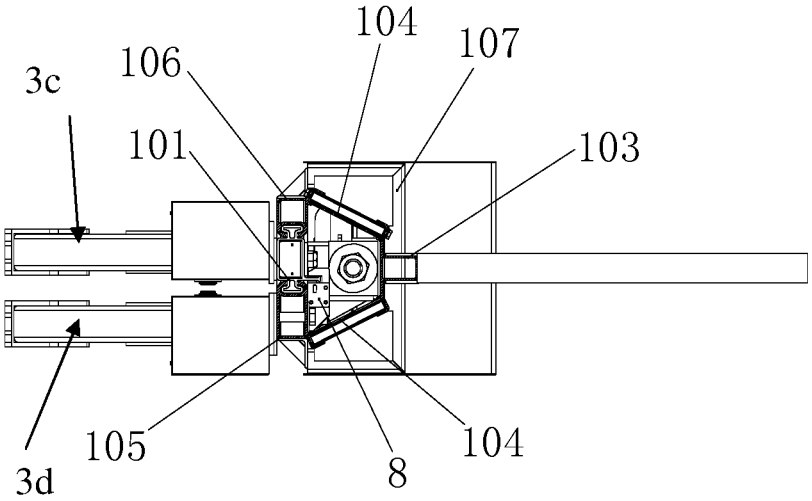
FIG. 3 is a cut-away view along the line A-A shown in FIG. 1.
Figure 4:
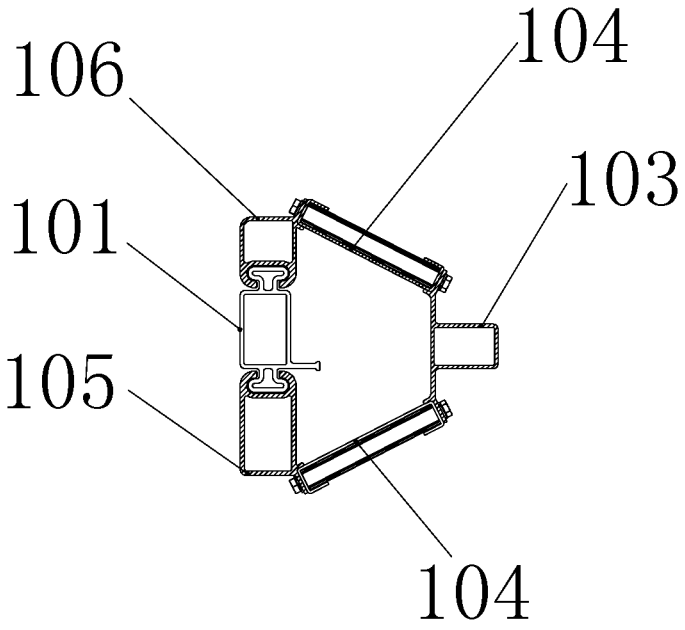
FIG. 4 is a structural schematic view of a hollow frame structure of the first embodiment of the present application.

In order to make the technical features, the propose and the technical effect of the present application more clearly, the present application will now be described in detail with reference to the accompanying drawings and embodiments.

As shown in FIGS. 1-19, the present application provides a sealed and integrated climbing scaffold comprising a hollow frame structure 1, a plurality of mechanical arm devices 3, a plurality of climbing fulcrums 5, a lifting system 6, and a construction operation platform structure 7.

The hollow frame structure 1 includes an inner guide rail 101 and an outer guide rail 102, and the inner guide rail 101 and the outer guide rail 102 are assembled together. At least two of the mechanical arm devices 3 (the mechanical arm device 3*a* and 3*c*) are fixed on the inner guide rail 101, and the height interval between the two mechanical arm devices 3 fixed on the inner guide rail 101 is equal to a height of one floor. At least two of the mechanical arm devices 3 (the mechanical arm device 3*b* and 3*d*) are fixed on the outer guide rail 102, and the height interval between the two mechanical arm devices 3 fixed on the outer guide rail 102 is equal to the height of one floor, too. The climbing fulcrums 5 are configured to be fixed on an architectural structure, for example, to be fixed on every floor of a building. The construction operation platform structure 7 is fixedly connected with the outer guide rail 102, and can be driven to move up and down by the outer guide rail 102. Each of the mechanical arm devices 3 includes a catch-and-release structure configured for capturing the climbing fulcrums 5, and each of the climbing fulcrums 5 can be provided with a cooperation structure, such as a cross-bar, a locating hole, or other structures, to cooperate with the catch-and-release structure. The inner guide rail 101 and the outer guide rail 102 are connected with the lifting system 6 respectively. The lifting system 6 is received in the hollow frame structure 1 to be well protected and insulated from outside pollution. The outer guide rail 102 includes a guide rail upright pole 103, two connecting plates 104, a left slide way 105 and a right slide way 106. The two connecting plates 104 are respectively fixed on the left side and the right side of the guide rail upright pole 103 by pins, rivets, or other connecting methods. The left slide way 105 and the right slide way 106 are fixedly connected with the two connecting plates 104 respectively by pins, rivets, or other connecting methods. The guide rail upright pole 103, the connecting plates 104, the left slide way 105, and the right slide way 106 are all made of aluminum alloy section bar, which is not only light in weight but also easy to be manufactured and molded. The outer guide rail 102 is formed by a plurality of components combined together. The outer guide rail 102 is simple in structure, convenient to be assembled, and has good sealing performance.

The mechanical arm devices 3 of the sealed and integrated climbing scaffold can capture the climbing fulcrums 5 by the catch-and-release structures. In the lifting process, either the outer guide rail 102 or the inner guide rail 101 can be elevated at first. For example, if the inner guide rail 101 needs to be elevated at first, the lifting system 6 elevates the inner guide rail 101 at first. During the lifting process, the outer guide rail 102 is held still and provides supporting and locating functions which are similar to the functions of a guide base in the prior art. When the mechanical arm devices 3 on the inner guide rail 101 move up to reach an upper one of the climbing fulcrums 5 and catch this climbing fulcrum 5, elevating the inner guide rail 101 is stopped and elevating the outer guide rail 102 is started. At present, the inner guide rail 101 is held still and provides supporting and locating functions until the mechanical arm devices 3 on the outer guide rail 102 move up to reach a higher one of the climbing fulcrums 5 and catch the higher climbing fulcrum 5. The descending process of the sealed and integrated climbing scaffold is similar to the lifting process, wherein the mechanical arm devices 3 on the inner guide rail 101 and the mechanical arm devices 3 on the outer guide rail 102 move alternately, too. In the present application, the outer guide rail 102 and the inner guide rail 101 of the sealed and integrated climbing scaffold act as a guide base and a guide rail alternately. Therefore, the sealed and integrated climbing scaffold of the present application can imitate the principal of human climbing movements by using the mechanical arm devices 3 fixed on the inner guide rail 101 and the outer guide rail 102 to move up and down, and thereby realize lifting and descending of high-rise construction platforms. The present application reduces the work of carrying guide bases of high-rise construction lifting platforms and the work of connecting and disconnecting attachment lifting points of high-rise construction lifting platforms, improves the levels of mechanization and automation in construction, and reduces workers' labor intensity. In one building, only one person can easily realize the work of elevating and descending the high-rise construction lifting platform, which can greatly improve the construction efficiency and save much workforce. The components of the hollow frame structure 1 of the present application are simple in assembly, and the hollow frame structure 1 realizes standardization and modularization. Therefore, these components can be assembled together in a factory, and the hollow frame structure 1 has good sealing performance. In this way, the lifting system 6 in the hollow frame structure 1 can be effectively protected, and the equipment failure rate can be reduced.

Each of the two connecting plates 104 includes a plurality of sub-plates (such as the sub-plates 104*a* and 104*b* in FIG. 2) combined together. Every sub-plate is small in size, and is convenient to be manufactured and carried. When the inner part of the hollow frame structure 1 is repaired, any one of the sub-plates can be selectively detached, and the stability of the whole climbing scaffold is not affected. Thus, the sealed and integrated climbing scaffold is simple in structure, and is convenient to maintain.

A dust-proof cover 2 is mounted at the top of the hollow frame structure 1. A plurality of dust-seal plates 4 cover a moving gap formed between each end of the inner guide rail 101 and an inner wall of the outer guide rail 102. A dust shield 10 is mounted outside the lifting system 6. All these designs can further improve dustproof effect and sealing performance of the sealed and integrated climbing scaffold. In this embodiment, the dust shield 10 is fixed on a mounting bracket 107.

The hollow frame structure 1 further includes the mounting bracket 107. The guide rail upright pole 103, the bottom of the left slide way 105, and the bottom of the right slide way 106 are all connected with the mounting bracket 107. The mounting bracket 107 is configured to improve the stability of the whole hollow frame structure 1, and to seal the bottom of the hollow frame structure 1.

Figure 5:
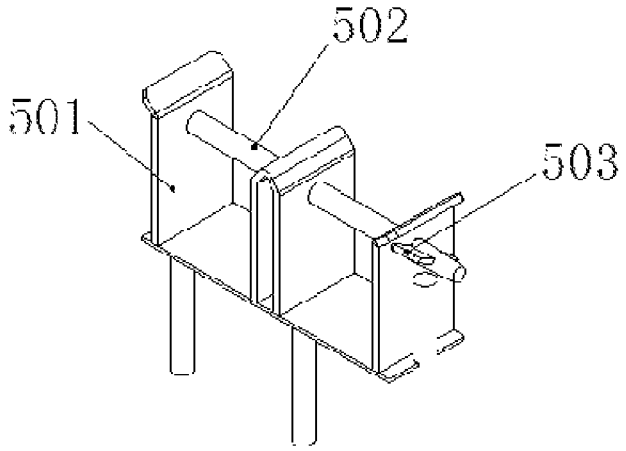
FIG. 5 is a structural schematic view of a climbing fulcrum of the first embodiment of the present application.
Figure 6:
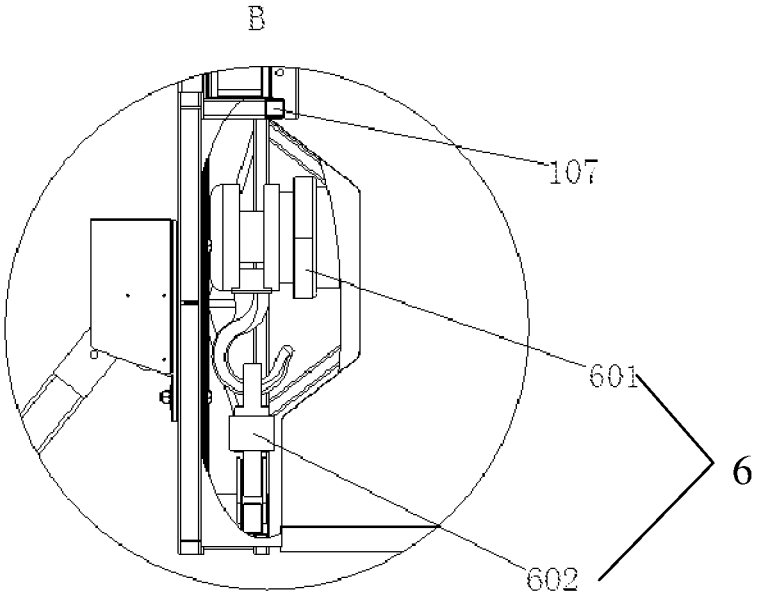
FIG. 6 is a partially enlarged view of the portion B of FIG. 2.
Figure 7:
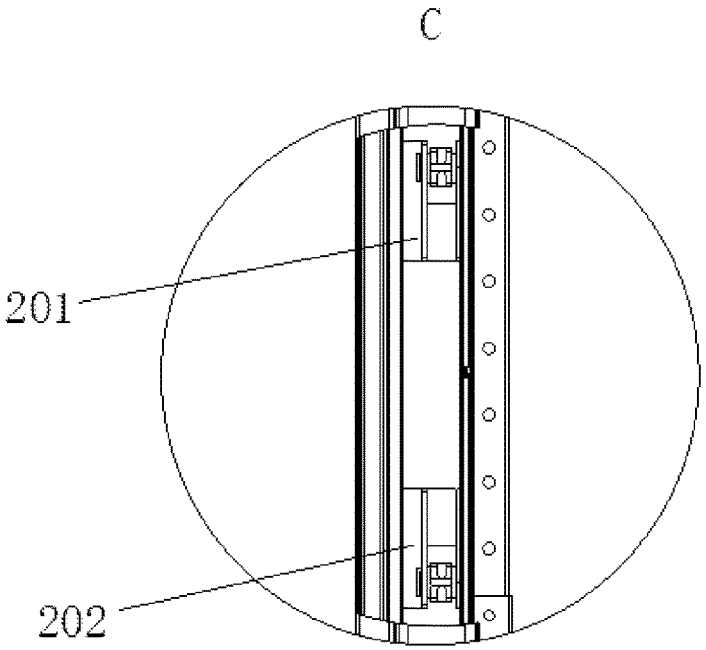
FIG. 7 is a partially enlarged view of the portion C of FIG. 2.
Figure 8:
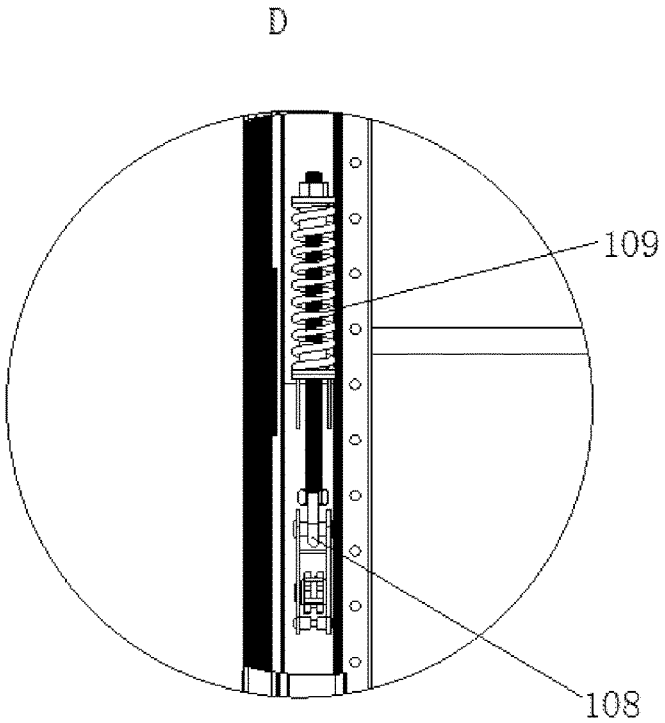
FIG. 8 is a partially enlarged view of the portion D of FIG. 1.
Figure 9:
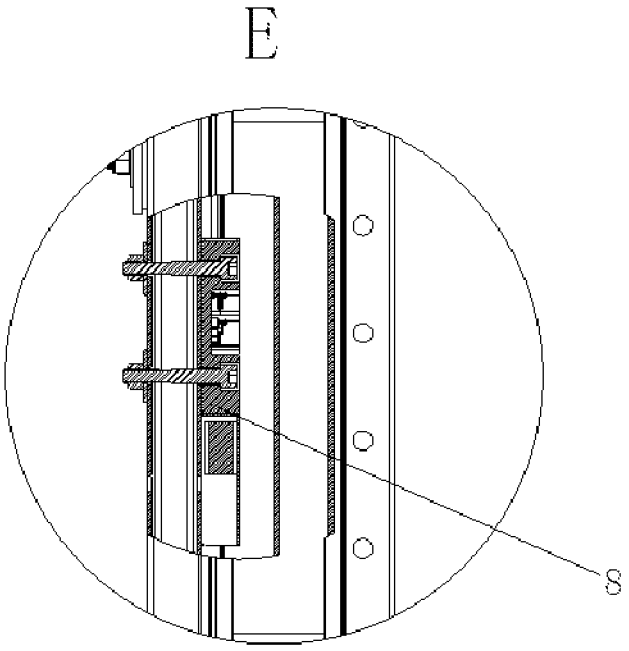
FIG. 9 is a partially enlarged view of the portion E of FIG. 2.

As shown in FIG. 5, each of the climbing fulcrums 5 in this embodiment includes a pedestal 501 and a pin shaft 502. The pin shaft 502 is fixed on the pedestal 501, and an anti-off pin 503 can be mounted at one end of the pin shaft 502. The pin shaft 502 is configured to be caught by the catch-and-release structure, so that the mechanical arm device 3 is fixed on the climbing fulcrum 5. It is understandable that using the pedestal 501 and the pin shaft 502 is just one preferable method, and the climbing fulcrum 5 can also be realized by using through-holes, grooves, or other methods.

As shown in FIGS. 10-14, each of the mechanical arm devices 3 includes a mechanical arm 301, an axle 304, and a supporting base 302. The mechanical arm 301 is rotatably connected with the supporting base 302 via the axle 304, and components such as gaskets, circlips, and so on, can be mounted at one end of the axle 304 to prevent the axle 304 separating from the supporting base 302. An outside protective cover 303 is mounted on the supporting base 302. The mechanical arm device 3 further includes a locking device, which includes a stop block 305, a solenoid valve 306, a lock plate 307, a dragging cable 308, a locating sleeve 312, a first spring 309, and a mounting plate 311. The stop block 305 is movable, and the mechanical arm 301 can be locked on any one of the climbing fulcrums 5 while the stop block 305 extends out of the locking device. An open slot 321 is defined in a distal end of the mechanical arm 301, and the catch-and-release structure of the mechanical arm devices 3 includes the open slot 321 and the locking device. When the stop block 305 extends outside, the mechanical arm 301 is locked on one of the climbing fulcrums 5; and when the stop block 305 retracts, the mechanical arm 301 is released from the climbing fulcrum 5. The catch-and-release structure in this embodiment is just one preferable method, and the catch-and-release structure can also be realized by using a mechanical hand or other devices.

One end of the dragging cable 308 is connected with the stop block 305. Particularly, one end of the dragging cable 308 extends into the stop block 305, and is mounted on the stop block 305 and limited by the lock plate 307. Since the end of the dragging cable 308 connected with the stop block 305 has a large head part, the lock plate 307 is stuck between the head part and the stop block 305, which ensures that the dragging cable 308 does not separate from the stop block 305. When the dragging cable 308 is pulled to move, the stop block 305 can move correspondingly. The other end of the dragging cable 308 is connected with the solenoid valve 306. When the solenoid valve 306 is powered on and closed, the dragging cable 308 is pulled and drives the stop block 305 to move away from the mechanical arm 301. In order to further limit the dragging cable 308, the locating sleeve 312 is sheathed on the dragging cable 308, and the locating sleeve 312 is further fixed on the mounting plate 311. One end of the first spring 309 abuts against the mounting plate 311, and the other end of the first spring 309 abuts against either the lock plate 307 or the stop block 305. The first spring 309 provides restoring force to drive the stop block 305 to move toward the mechanical arm 301. When the solenoid valve 306 is powered on and closed, the dragging cable 308 is pulled and drives the stop block 305 to retract, that is, the stop block 305 moves away from the mechanical arm 301. Thus, the mechanical arm 301 can't be locked on the climbing fulcrum 5. Meanwhile, the first spring 309 is contracted. When the solenoid valve 306 is powered off, the stop block 305 extends out and moves towards the mechanical arm 301, so that the mechanical arm 301 is locked on embedded parts in the building. It is understandable that the locking device in this embodiment is just one preferable method, and can also be realized by other methods, as long as the stop block 305 can be enabled to extend and retract and thereby finish the locking and releasing actions.

Figure 10:
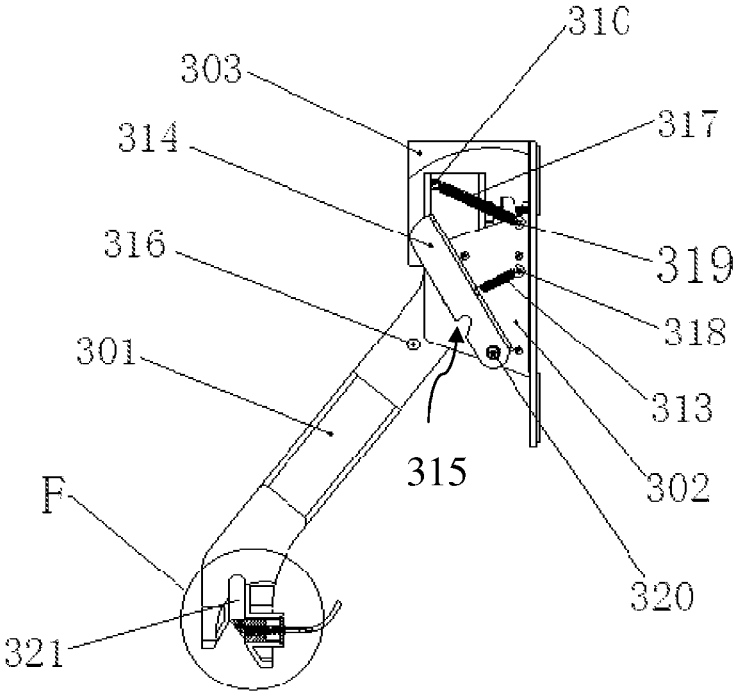
FIG. 10 is a structural schematic view of a mechanical arm device of the first embodiment of the present application.
Figure 11:
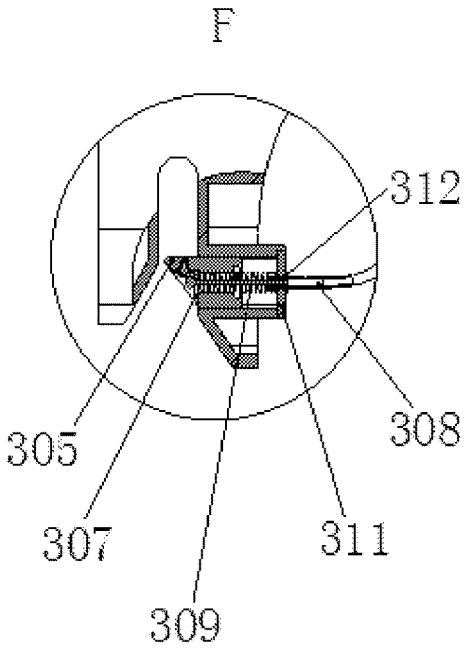
FIG. 11 is a partially enlarged view of the portion F of FIG. 10.
Figure 12:
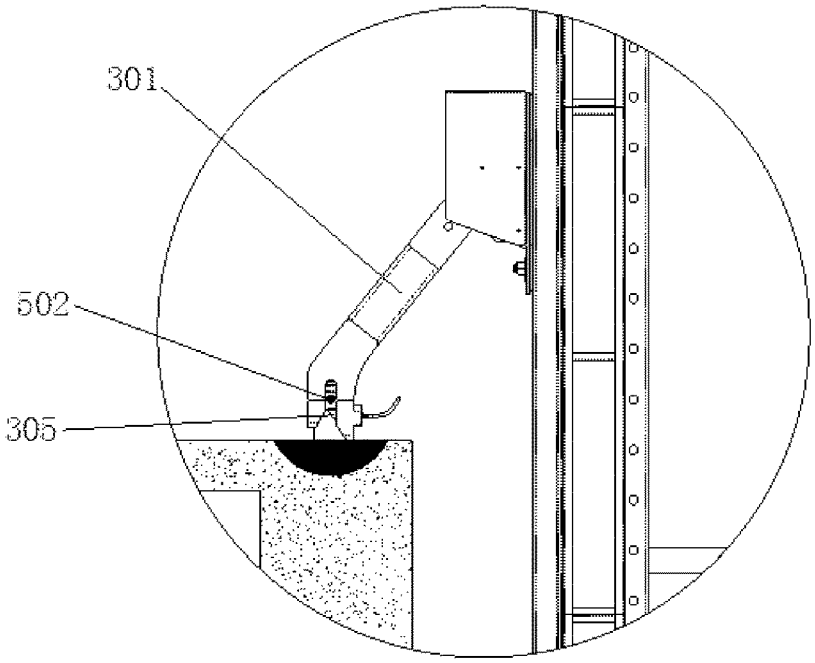
FIG. 12 is a schematic view of a mechanical arm device locked with a climbing fulcrum, according to the first embodiment of the present application.
Figure 13:
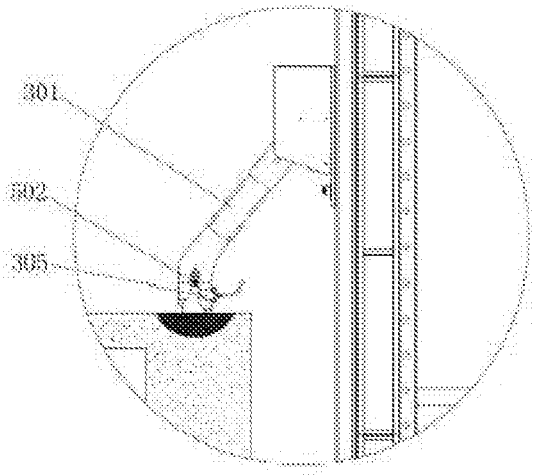
FIG. 13 is a schematic view of a mechanical arm device released from a climbing fulcrum, according to the first embodiment of the present application.
Figure 14:
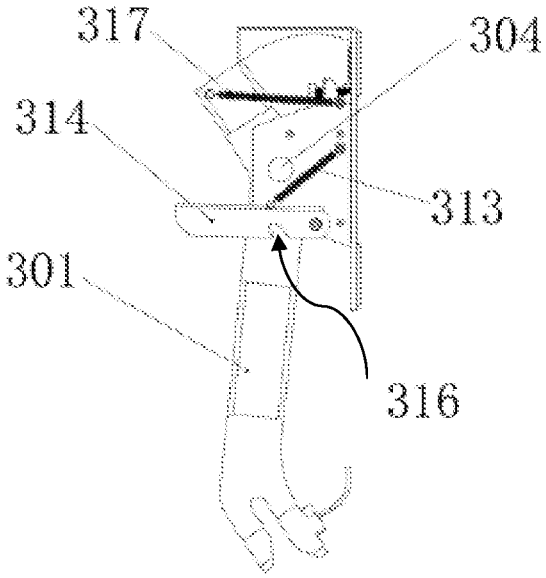
FIG. 14 is a structural schematic view of a mechanical arm secured with a trigger-rod, according to the first embodiment of the present application
Figure 15:
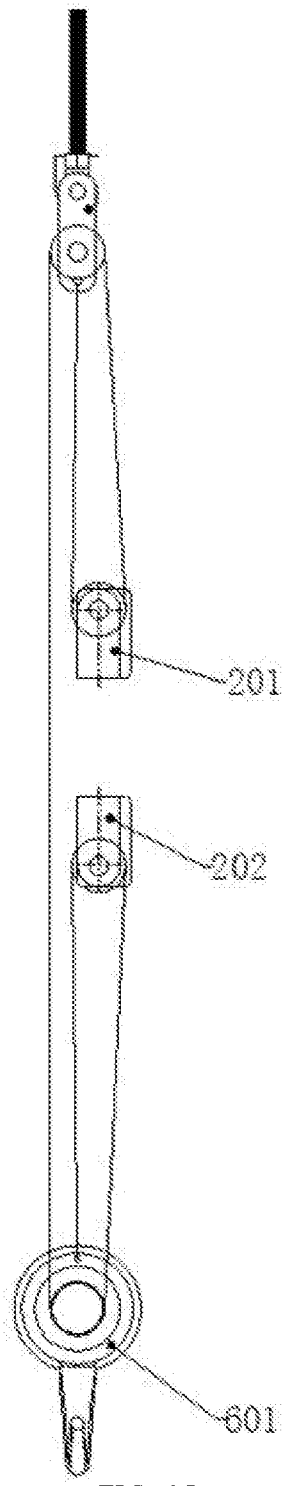
FIG. 15 is a structural schematic view of a lifting system, according to the first embodiment of the present application.

As shown in FIG. 10 and FIG. 14, each of the mechanical arm devices 3 further includes a second spring 313 and a trigger-rod 314. The trigger-rod 314 is rotatably connected with the supporting base 302. In this embodiment, the trigger-rod 314 is mounted on the supporting base 302 via a fixed bolt 420. The trigger-rod 314 is configured to hold the mechanical arm 301 and prevent the mechanical arm 301 from rotating. In this embodiment, a limiting notch 315 is defined in the trigger-rod 314, and a limiting pin 316 is mounted on the mechanical arm 301. Understandably, the position where the limiting notch 315 is defined and the position where the limiting pin 316 is mounted are interchangeable, that is, the limiting notch 315 can be defined in the mechanical arm 301 and the limiting pin 316 can be mounted on the trigger-rod 314. The means for enabling the trigger-rod 314 to hold the mechanical arm 301 is not limited to the use of the limiting notch 315 and the limiting pin 316, and can also be realized by using hooks or other methods. Two ends of the second spring 313 are respectively fixed on the supporting base 302 and the trigger-rod 314. Particularly, a connecting screw 318 is mounted on the supporting base 302, and one end of the second spring 313 is fixed on the connecting screw 318. While the trigger-rod 314 is rotating, the second spring 313 is stretched and provides restoring force to drive the trigger-rod 314 to rotate in reverse.

As shown in FIG. 10 and FIG. 14, a third spring 317 is connected with the mechanical arm device 3, and two ends of the third spring 317 are fixed on the supporting base 302 and the mechanical arm 301 respectively. In particular, a fixing screw 319 is mounted on the supporting base 302, and a fixing pin 310 is mounted on the mechanical arm 301. Two ends of the third spring 317 are respectively fixed on the fixing screw 319 and the fixing pin 310. While the bottom of the mechanical arm 301 is rotated inwards and the top of the mechanical arm 301 is rotated outwards, the third spring 317 is stretched. Thus, the trigger-rod 314 is rotated to hold the limiting pin 316 in the limiting notch 315, and the second spring 313 is stretched too. In this situation, neither the trigger-rod 314 nor the mechanical arm 301 can rotate without external force. If the external force makes the limiting pin 316 separate from the limiting notch 315, the trigger-rod 314 and the mechanical arm 301 will return under the actions of the second spring 313 and the third spring 317.

As shown in FIGS. 6-9 and FIG. 15, the lifting system 6 includes an electric hoist 601 and a gravity sensor 602. A dragging hook and a dragging chain are mounted on the electric hoist 601, and the dragging hook is connected with the gravity sensor 602. The structures of the electric hoist 601 and the gravity sensor 602 are prior art, therefore, they do not need to be detailed here. The outer guide rail 102 includes an up-loop hook 201 and a down-loop hook 202, and the inner guide rail 101 includes a hanging base 108. One end of the dragging chain runs through the up-loop hook 201 and then is fixed on the hanging base 108, and the other end of the dragging chain runs through the down-loop hook 202 and then is fixed on the electric hoist 601. The inner guide rail 101 and the outer guide rail 102 can be elevated by the electric hoist 601. A pressure spring 109 is mounted on the hanging base 108. Under the action of the pressure spring 109, the dragging chain of the electric hoist 601 can be tightened to ensure the lifting effect.

Figure 16:
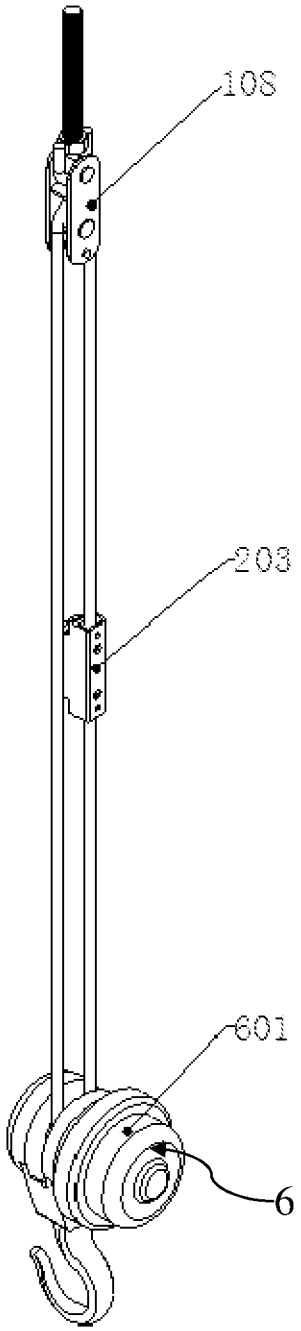
FIG. 16 is a structural schematic view of a lifting system, according to a second embodiment of the present application.
Figure 17:
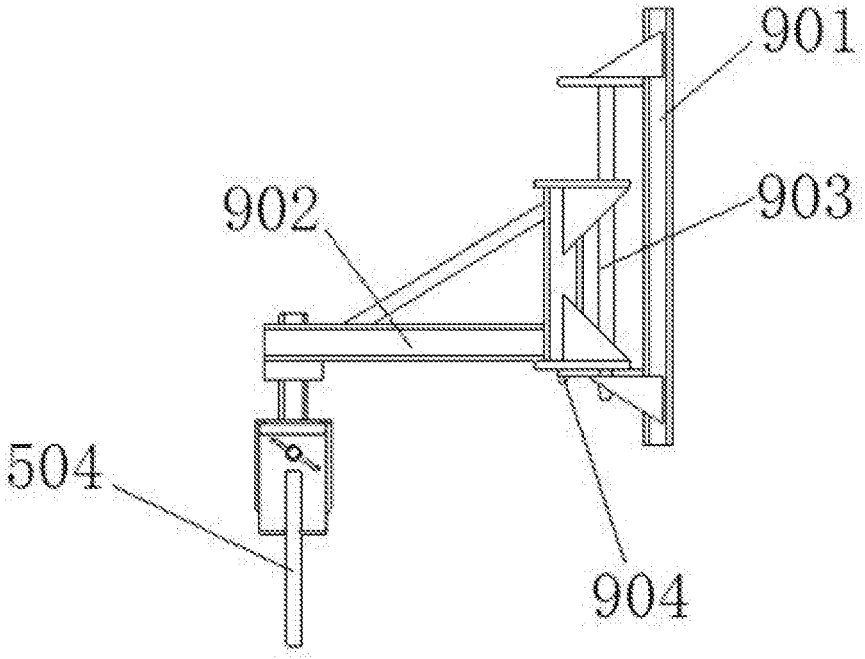
FIG. 17 is a front view of a retainer, according to the first embodiment of the present application.
Figure 18:
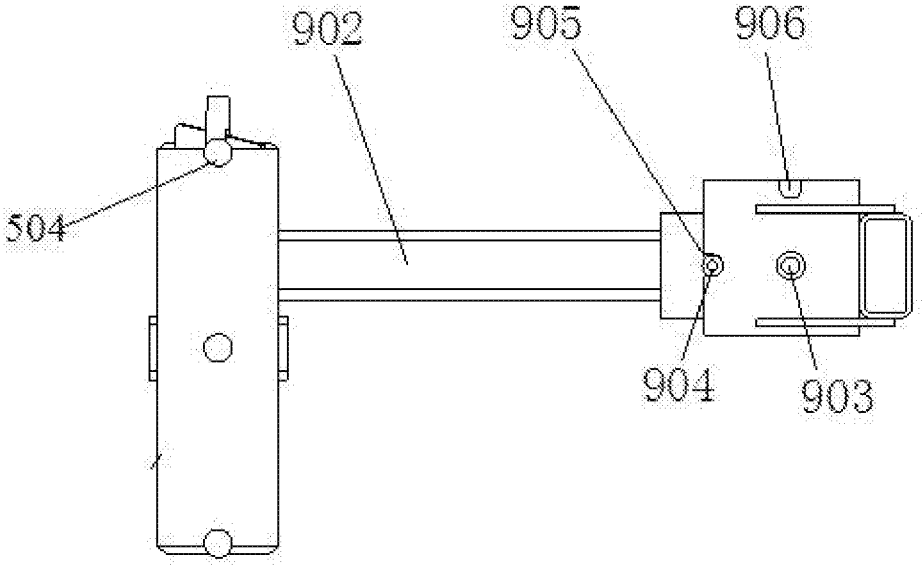
FIG. 18 is a top view of the retainer shown in FIG. 16.
Figure 19:
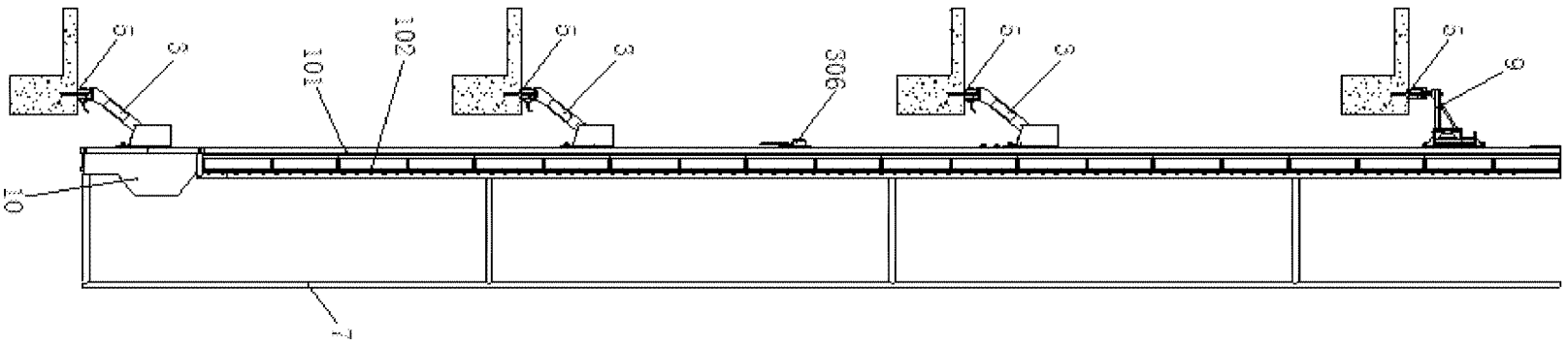
FIG. 19 is a structural schematic view of a sealed and integrated climbing scaffold mounted to a high-rise building, according to the first embodiment of the present application.

FIG. 16 shows another embodiment of the lifting system 6. The lifting system 6 of the another embodiment also includes the electric hoists 601 and the gravity sensor 602, the dragging hook and the dragging chain are mounted on the electric hoists 601, and the dragging hook is connected with the gravity sensor 602. The hanging base 108 is mounted on the inner guide rail 101, and the dragging chain runs through a chain wheel of the electric hoist 601 and a chain wheel of the hanging base 108 to form a closed chain. A connector 203 is mounted on the outer guide rail 102, and the connector 203 is fixedly connected with the dragging chain of the electric hoist 601. The inner guide rail 101 and the outer guide rail 102 can be elevated by the electric hoist 601. Except above two embodiments, the lifting system 6 can also adopt other methods, such as chain driving or gear driving, to realize the lifting operations. The two embodiments just show two preferable methods.

The sealed and integrated climbing scaffold further comprises a falling protector 8 and an anti-falling rod 10. The falling protector 8 is fixed on the outer guide rail 102, and the anti-falling rod 10 is fixed on the inner guide rail 101. The falling protector 8 cooperates with the anti-falling rod 10 to prevent the sealed and integrated climbing scaffold from falling. The detailed structures for prevent the sealed and integrated climbing scaffold from falling are prior art, and thus they do not need to be detailed here. The falling protector 8 in this embodiment is a rotary wheel falling protector, and it can also be a pendular needle falling protector or other anti-falling devices.

The sealed and integrated climbing scaffold further comprises a retainer 9 and a plurality of embedded screws 504. The retainer 9 includes a fixing base 901, a locating and supporting arm 902, and a rotating shaft 903. Each of the embedded screws 504 is fixedly connected with each of the climbing fulcrum 5, and any one of the embedded screws 504 is capable of being detachably connected with the locating and supporting arm 902. The fixing base 901 is mounted on either the inner guide rail 101 or the outer guide rail 102, the locating and supporting arm 902 is rotatably connected to the fixing base 901 by the rotating shaft 903, and the locating and supporting arm 902 is capable of rotating around the rotating shaft 903. A stop pin 904 is mounted on the locating and supporting arm 902, and a first notch 905 and a second notch 906 are defined in the fixing base 901 to cooperate with the stop pin 904. The retainer 9 is configured of determine the location of the embedded screw 504. While the locating and supporting arm 902 is rotated to be perpendicular to the outside surface of a building, the stop pin 904 cooperates with the first notch 905 for limitation. The embedded screw 504 mounted on the locating and supporting arm 902 is maintained at the position of an appointed storey. When constructing the appointed storey, the embedded screw 504 is wrapped in the building materials, such as concrete. The embedded screw 504 is fixed on the appointed storey after the concrete is solidified, so that it is convenient to assemble the climbing fulcrum 5. By using the retainer 9, the location of the embedded screw 504 can be accurately determined, and the work of pre-burying the embedded screw 504 becomes more convenient. Having fixed the embedded screw 504, the embedded screw 504 is separated from the locating and supporting arm 902, the locating and supporting arm 902 is rotated to be parallel to the outside surface of the building, and the stop pin 904 cooperates with the second notch 906 for limitation.

The present application also provides a method for using the aforementioned sealed and integrated climbing scaffold, which comprises the following steps:

S1: rotating the locating and supporting arm 902 mounted on the retainer 9 of the sealed and integrated climbing scaffold to be perpendicular to the outside surface of a building; fixing an embedded screw 504 of each of the climbing fulcrums 5 on the locating and supporting arm 902 of the climbing fulcrum 5 for location during the early stage of embedding; after firmly embedding the embedded screw 504 into concrete, rotating the locating and supporting arm 902 to be parallel to the outside surface of the building, and fixedly connecting the climbing fulcrums 5 with the embedded screws 504 respectively;

S2: positioning two mechanical arm devices 3 of the sealed and integrated climbing scaffold at the same height and catching the climbing fulcrums 5 fixed on the building at the same time; the solenoid valve 306 locked on the inner guide rail 101 of the sealed and integrated climbing scaffold, powering on the solenoid valve 306 and then the solenoid valve 306 being closed by the suction; meanwhile, under the action of the solenoid valve's 306 suction, releasing the locking device mounted under the mechanical arm device 3 of the inner guide rail 101 by the pulling force of the dragging cable 408 of the locking device; while elevating the inner guide rail 101 to the climbing fulcrum 5 located at the higher floor of the building by the lifting system 6 of the sealed and integrated climbing scaffold, the mechanical arm device 3 mounted on the inner guide rail 101 automatically catching the climbing fulcrum 5 fixed on the higher floor and firmly locking on the climbing fulcrum 5; then taking the inner guide rail 101 as the supporting, the locating and the guiding to elevate an outer guide rail 102 of the sealed and integrated climbing scaffold and the construction operation platform structure 7 of the sealed and integrated climbing scaffold by the lifting system 6;

S3: when descending the construction platform of the sealed and integrated climbing scaffold, the inner guide rail 101 and the mechanical arm device 3 mounted on the inner guide rail 101 holding still; powering on the solenoid valve 306 locked on the outer guide rail 102 and then the solenoid valve 306 being closed by the suction; meanwhile, under the action of the solenoid valve's 306 suction, releasing the locking device mounted under the mechanical arm device 3 of the outer guide rail 102 by the pulling force of the dragging cable 408; elevating the outer guide rail 102 for a distance by the lifting system 6, then rotating a mechanical arm 301 of the mechanical arm device 3 down an angle under the control of the solenoid valve 306, and the trigger-rod 314 of the mechanical arm device 3 limiting the mechanical arm 301 at the same time, then descending the outer guide rail 102 by the lifting system 6; the trigger-rod 314 touching the outside surface of the building during the descending process of the outer guide rail 102, and separating the trigger-rod 314 from the mechanical arm 301; under the action of the second spring 313 of the mechanical arm device 3 and the third spring 317 of the mechanical arm device 3, the trigger-rod 314 and the mechanical arm 301 rotating to return and backing to the normal state respectively.

Although the present application is illustrated with the embodiments accompanying the drawings, the present application is not limited to the above-mentioned specific embodiments, and the above-mentioned embodiments are only for illustration, not for limitation. In the inspiration of the present, those skilled in the art may make many modifications for the present application, without going beyond the purpose and the scope the claims intend to protect of the present application, such as the case cover formed integrated with the cover body, all these belong to the protection of the present application.

The invention claimed is:

1. A sealed and integrated climbing scaffold, comprising a hollow frame structure, a plurality of mechanical arm devices, a plurality of climbing fulcrums, a lifting system, and a construction operation platform structure; wherein, the hollow frame structure includes an inner guide rail and an outer guide rail, the inner guide rail and the outer guide rail are assembled together;

at least two of the mechanical arm devices are fixed on the outer guide rail, and at least another two of the mechanical arm devices are fixed on the inner guide rail;

the climbing fulcrums are configured to be fixed on every floor of a building; each of the mechanical arm devices includes a catch-and-release structure configured for catching the climbing fulcrums; the inner guide rail and the outer guide rail are connected with the lifting system respectively, the lifting system is received in the hollow frame structure, and the construction operation platform structure is fixedly connected with the outer guide rail;

the outer guide rail includes a guide rail upright pole, two connecting plates fixed on two opposite sides of the guide rail upright pole respectively, and two slide ways fixedly connected with the two connecting plates respectively;

each of the two connecting plates includes a plurality of sub-plates combined together;

each of the climbing fulcrums includes a pedestal and a pin shaft fixed on the pedestal; an anti-off pin is mounted at one end of the pin shaft;

the outer guide rail includes an up-loop hook and a down-loop hook, and the inner guide rail includes a hanging base; a pressure spring is mounted on the hanging base;

the sealed and integrated climbing scaffold further comprises a dust-proof cover mounted at a top of the hollow frame structure;

the hollow frame structure further includes a mounting bracket;

the sealed and integrated climbing scaffold further comprises a dust shield mounted outside the mounting bracket.

2. The sealed and integrated climbing scaffold according to claim 1, wherein the inner guide rail is made of aluminum alloy section bar.

3. The sealed and integrated climbing scaffold according to claim 1, wherein the guide rail upright pole, the connecting plates, and the slide ways are all made of aluminum alloy section bar.

4. The sealed and integrated climbing scaffold according to claim 1, wherein the mounting bracket is connected with the guide rail upright pole and a bottom of each of the slide ways.

5. The sealed and integrated climbing scaffold according to claim 1, wherein each of the mechanical arm devices includes a mechanical arm, an axle, and a supporting base, and the mechanical arm is rotatably connected with the supporting base via the axle.

6. The sealed and integrated climbing scaffold according to claim 5, wherein each of the mechanical arm devices further includes a locking device configured for locking the mechanical arm on any one of the climbing fulcrums; the locking device includes a stop block, a solenoid valve, a lock plate, a dragging cable, a locating sleeve, a first spring and a mounting plate; the stop block is configured for locking the mechanical arm on any one of the climbing fulcrums, one end of the dragging cable is connected with the solenoid valve, and another end of the dragging cable extends into the stop block and is mounted on the stop block by the lock plate; the locating sleeve is sheathed on the dragging cable, and the locating sleeve is further fixed on the mounting plate; one end of the first spring abuts against the mounting plate, and another end of the first spring abuts against either the lock plate or the stop block.

7. The sealed and integrated climbing scaffold according to claim 6, wherein the catch-and-release structure of each of the mechanical arm devices includes the locking device and an open slot defined in a distal end of the mechanical arm of each of the mechanical arm devices and corresponding to the pin shaft of any one of the climbing fulcrums; when the stop block extends outside, the mechanical arm of each of the mechanical arm devices is locked on one of the climbing fulcrums; and when the stop block extends outward, a respective mechanical arm of each of the mechanical arm devices is configured to be locked on one of the climbing fulcrums.

8. The sealed and integrated climbing scaffold according to claim 6, wherein each of the mechanical arm devices further includes a second spring and a trigger-rod configured to hold the mechanical arm of each of the mechanical arm devices, the trigger-rod is rotatably connected with the supporting base, and two ends of the second spring are respectively fixed on the supporting base of each of the mechanical arm devices and the trigger-rod.

9. The sealed and integrated climbing scaffold according to claim 8, wherein the trigger-rod defines a limiting notch, and the mechanical arm of each of the mechanical arm devices includes a limiting pin corresponding to the limiting notch.

10. The sealed and integrated climbing scaffold according to claim 6, wherein each of the mechanical arm devices further includes a third spring, and two ends of the third spring are respectively fixed on the supporting base of each of the mechanical arm devices and the mechanical arm of each of the mechanical arm devices.

11. The sealed and integrated climbing scaffold according to claim 1, wherein the sealed and integrated climbing scaffold further comprises a retainer and an embedded screw; the retainer includes a fixing base, a locating and supporting arm and a rotating shaft; the fixing base is mounted on either the outer guide rail or the inner guide rail, the locating and supporting arm is rotatably connected with the fixing base by the rotating shaft, the locating and supporting arm is capable of rotating around the rotating shaft; the locating and supporting arm includes a stop pin, and a first notch and a second notch are defined in the fixing base; the stop pin is configured to cooperate with the first notch for limitation while the locating and supporting arm is rotated until it is perpendicular to an outside surface of a building, and is configured to cooperate with the second notch for limitation while the locating and supporting arm is rotated until it is parallel to the outside surface of the building; the embedded screw is fixedly connected with the climbing fulcrums, and the embedded screw is capable of detachably connecting with the locating and supporting arm.

* * * * *